United States Patent [19]

Hammersmith

[11] 4,035,220

[45] July 12, 1977

[54] METHOD FOR MAKING POROUS FILTER TIP

[75] Inventor: James R. Hammersmith, Jeffersonville, Ind.

[73] Assignee: Brown & Williamson Tobacco Corporation, Louisville, Ky.

[21] Appl. No.: 554,846

[22] Filed: Mar. 3, 1975

Related U.S. Application Data

[62] Division of Ser. No. 404,479, Oct. 9, 1973, abandoned.

[51] Int. Cl.[2] ..... B32B 7/14

[52] U.S. Cl. ..... 156/291; 131/10 A; 131/15 B

[58] Field of Search ..... 156/185, 187, 191, 277, 156/290, 291; 131/10 A, 10.3, 10.5, 10.7, 10.9, 11, 12, 13, 14, 15 B, 32, 35, 90

[56] References Cited

U.S. PATENT DOCUMENTS

| | | | |
|---|---|---|---|
| 2,988,088 | 6/1961 | Schur | 131/15 B |
| 3,251,727 | 5/1966 | Reynolds et al. | 156/291 |
| 3,329,547 | 7/1967 | Denenberg | 156/291 |
| 3,482,579 | 12/1969 | Davis | 131/15 B |
| 3,547,131 | 12/1970 | Dock | 131/15 B |
| 3,621,851 | 11/1971 | Hesbett et al. | 131/10.7 |
| 3,664,350 | 5/1972 | Wall | 131/10.5 |
| 3,805,800 | 4/1974 | Summers | 131/10 A |

*Primary Examiner*—Caleb Weston
*Attorney, Agent, or Firm*—William J. Mason

[57] ABSTRACT

A ventilated filter for a smoking product, particularly a smoking tobacco product, is provided by adhering inherently porous tipping wrap to inherently porous plug wrap by a multiplicity of randomly positioned, nonporous discrete areas of adhesive, thus leaving open areas for the air to enter the filter. Production of the porous filter can be accomplished by observing proper adhesive viscosities and solids weight content and by ensuring the adhesive is applied on the applicator in a film having the appropriate depth and on the tipping paper in the appropriate amount per unit area.

6 Claims, 5 Drawing Figures

FIG. 4
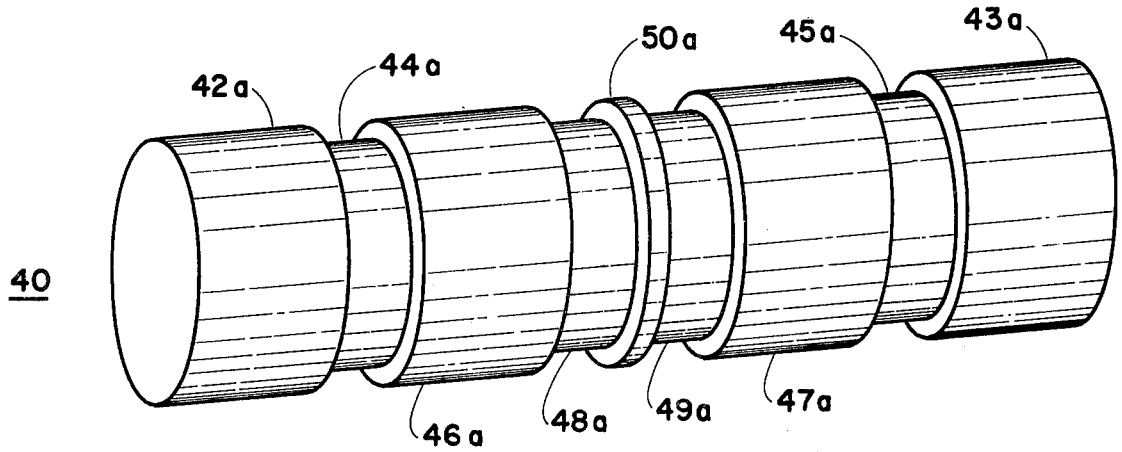
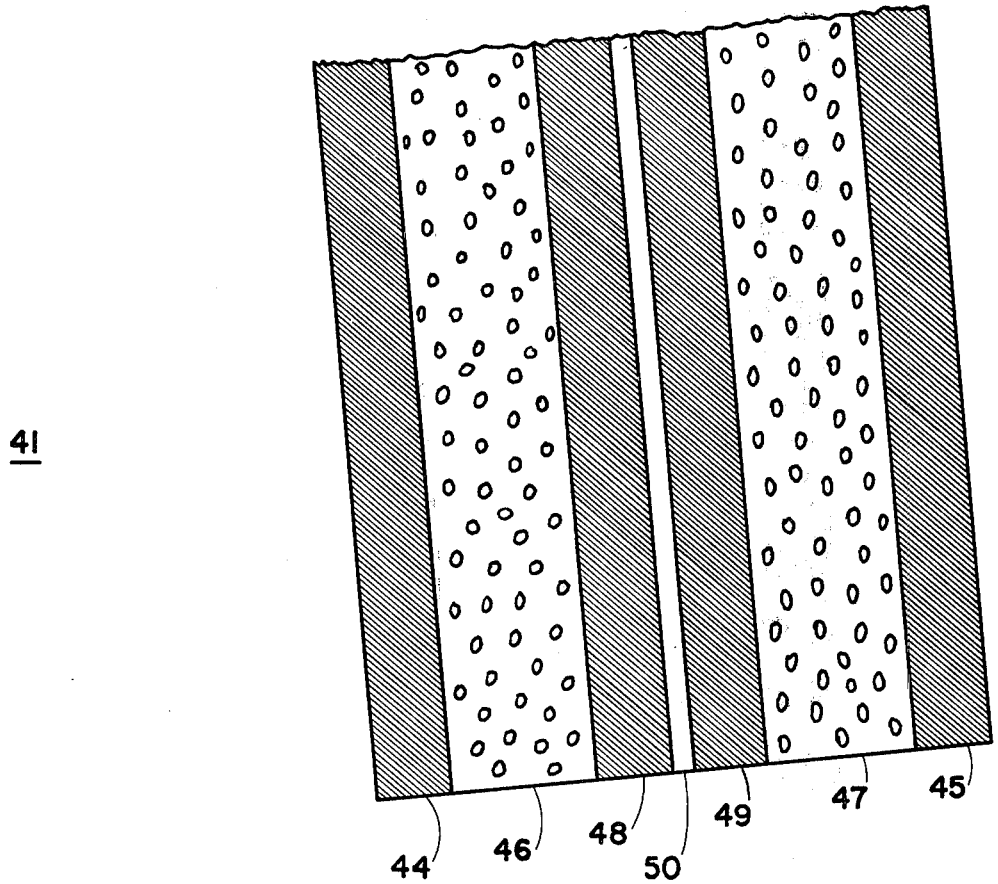
FIG. 5

METHOD FOR MAKING POROUS FILTER TIP

RELATIONSHIP TO COPENDING APPLICATIONS

This is a division of application Ser. No. 404,479, filed Oct. 9, 1973, now abandoned.

This application is related to the copending application of Thomas Wade Summers, Ser. No. 193,124 filed Oct. 27, 1971, and assigned to the same assignee as the present invention.

BACKGROUND OF THE INVENTION

Smoking tobacco products, particularly tobacco cigarettes, having ventilated areas in the region of the tip have been suggested for a number of years. In particular, the mixing of air with the smoke passing through the filter tip was felt to give a cooler and less harsh smoke.

In recent years, more sophisticated techniques for ventilating of cigarette tips have been proposed, some of which have been made commercially available. In addition to providing a cooler and less harsh smoke, it has been found that the addition of air to the smoke passing through the filter reduces the amounts of various smoke constituents delivered to the smoker.

In general, the ventilation in the filter area can be provided by two methods, or combinations of these methods. The two methods involve perforation and the use of inherently porous materials. Thus, the plug wrap which surrounds the filter element can be perforated and perforations in registry therewith can be formed in the tipping paper which surrounds both the plug wrap and the tobacco section. Further, both the plug wrap and the tipping paper can be formed of inherently porous material. Still further, either the plug wrap or tipping can be preperforated and the other component made of an inherently porous material. Consequently, it is necessary that areas in the vicinity of the perforation not be covered with perforation-blocking adhesive. It has been found that a more even and consistent distribution of air into the smoke passing through the filter can be obtained when inherently porous materials are employed rather than perforated materials in a manner described in the referenced copending application Ser. No. 193,124.

SUMMARY OF THE INVENTION

In accordance with the present invention, it has been found through the precise control of certain gluing steps in the fabrication of ventilated filter tips and conditions pertaining thereto that a new and unique ventilated filter tip may be produced. More particularly, by applying a continuous film of adhesive having a specified thickness, viscosity, and solids content to an applicator and then transferring the adhesive to an "inherently porous" tipping paper which is then adhered to an inherently porous wrap, a multiplicity of randomly positioned, nonporous discrete areas having a predetermined average diameter and depth are formed between the two wraps, thereby permitting ventilation in between the discrete areas.

"Laking" is defined for purposes of this disclosure as the ability of the adhesive to bead or collect into small, definite areas. It is a phenomenon which generally occurs to some degree between objects adhered together by most known adhesives when the objects are not totally wetted by the adhesive. Filters used with most smoking products are comprised of the rod, a plug wrap wrapped about the rod, and the tipping paper wrapped about and adhered to the plug wrap. Laking of the adhesive occurs between the plug wrap and tipping paper. Laking, however, as an occurrence was a factor of no consequence in the manufacture of non-ventilated or perforated filters which employ nonporous plug wrap and tipping paper, because perfortions were either added after the filter tip was completely assembled or the manufacturer ensured that there was a wide adhesive-free area about the perforated region. In other prior art, ventilated filter tips which discuss the use of porous materials about the filter rod, efforts were made to exclude adhesive in the regions of ventilation because, in the opinion of those skilled in the art, the adhesive blocked the flow of air into the filter. Thus, those in the prior art did not recognize the beneficial aspects of controlled laking. As taught by the disclosure herein, by the judicious control of laking characteristics of an adhesive so as to form a multiplicity of randomly positioned, nonporous discrete areas of adhesive adhering the tipping paper to the plug wrap permits the formation of an "open area" for proper and desired ventilation. Similarly, a unique filter tip having a multiplicity of discrete, nonporous areas is described between otherwise inherently porous plug wrap and tipping paper having a porous area sufficient to provide the desired ventilation.

The plug wrap and tipping paper necessary for the proper operation of the product of the present invention are inherently porous. That is, porosity of the wraps and tipping paper is a characteristic resulting from the manufacturing process as opposed to various perforating mechanical techniques performed on the wraps and tipping paper after manufacture. Thus, porosity of inherently porous materials as discussed in this disclosure also possesses uniform porosity as opposed to perforated materials, which are porous only in the region of the perforation.

It has been found that predicting precisely the ventilation rate achievedby a given porous tipped filter is quite complex and depends upon several independent and dependent parameters. A simple expression setting forth the ventilation rate is $$V_R = f(V_{ptg} \cdot A_v \cdot \Delta_v) \quad (1)$$

where $V_R$ is the ventilation rate (cm³/sec), $V_{ptg}$ is the porosity of the assembled tip ventilating area (cm³sec) measured across a 1.27 cm² area at 2.49 kilobarye differential, $A_v$ is the tipping area where ventilation occurs (cm²), and $\Delta_v$ is the pressure differential across the ventilating area during ventilation (kilobarye).

Changing the values of the above three parameters will, as seen from expression (1), change the ventilation rate and, consequently, change the amount of smoke constituents reaching the smoker.

The assembled porosity, $V_{ptg}$, is a measure of how well air will flow through the three layer laminate of tipping-adhesive-plug wrap. Its value can range, theoretically, from zero porosity to a maximum porosity, $V_{pt}$, determined by the tipping-plug wrap alone.

The ventilating area, $A_v$, is the total face area of the cut tipping minus the portion of the tipping overlapping the tobacco section, the tipping seam, and the portion in the smoker's mouth. Assuming the portion placed in the smoker's mouth is substantially constant, the ventilation area may be varied by changing filter length and/or diameter.

The pressure differential, $\Delta_v$, is a smoker influenced variable and depends on the physical construction of the filter, tobacco section, and the volume flow rates through those sections. It is evident that ventilation rate increases with increasing pressure differential.

Thus, as may be noted from the above discussion, the important parameter among the three mentioned is the porosity of the assembled filter tip, $V_{ptg}$. $V_{ptg}$ is relates to $A_g$, the fractional area within a given ventilation area ($A_v$) actually blocked off by the dry adhesive lakes, as follows:

$$V_{ptg} = (1 - A_g)\ V_{pt} \qquad (2)$$

where $V_{pt}$ is $V_{ptg}$ at a maximum.

It has been determined that $A_g$ depends primarily upon the following factors:

a. the thickness of the film of adhesive placed on an applicator;

b. the viscosity of the adhesive; and c. the solids content of the adhesive.

The factors determine the amount of adhesive per area transferred to the porous tipping paper, which results in a specified area, i.e., $A_g$, occupied by adhesive lakes. The precise relationship among the various factors above is not entirely understood, but it has been found that by observing values within certain ranges that desired blocking areas can be made. Specifically, by placing on an applicator a continuous film of adhesive having a thickness of between about 5 to 50 microns, a viscosity of between about 5 to $14 \times 10^3$ centipoise, and a solids content of 40 to 60% by weight, and then transferring the adhesive to inherently porous tipping paper for adherence to plug wrap about the filter rod, a multiplicity of randomly positioned, nonporous discrete areas will be formed and thereby providing a desired ventilation or open area of between 0.02 and 0.7 $cm^2$ per $cm^2$ of tipping. In other words, between 2 to 70% of the tipping is open or porous. The amount of adhesive needed to provide the open area to the tipping paper is about 0.8 to 3 $mg/cm^2$ wet adhesive weight.

By knowing the parameter $V_{ptg}$ as determined from the blocking area, reasonable calculations can be made as to the amount of air which will enter the smoke passing through the filter during smoking. As is well known, there is a relationship between the amount of air which enters the filter during smoking and the reduction of various components of the smoke which pass into the filter.

In accordance with another embodiment of the present invention, it has been found advantageous to apply extra amounts of adhesive to areas of the tipping wrap to be wrapped around regions such as the joint between the tobacco end and filter tip to avoid ventilation variances caused by filter tip-tobacco rod misfits. Similarly, because the smoker himself may cause variance, depending upon the length of tip inserted in the mouth, extra glue provided in this area of the tip will eliminate the variances. These and other embodiments and advantages will become apparent from the following description and drawings.

BRIEF DESCRIPTION OF THE DRAWINGS

FIG. 4 is a perspective view of an adhesive applicator which may be employed to fabricate the ventilated filter tip illustrated in FIG. 3.

FIG. 5 illustrates a porous tipping paper treated in accordance with the present invention.

DESCRIPTION OF THE PREFERRED EMBODIMENTS

Figure 1:
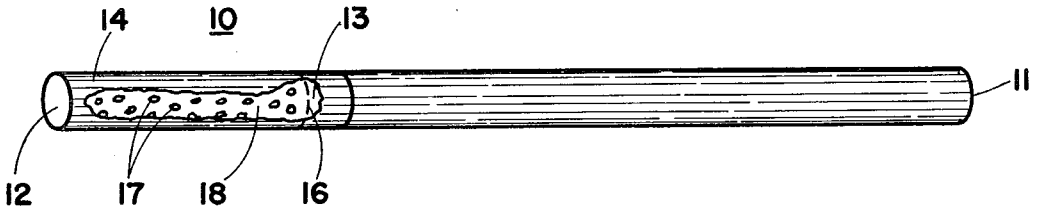
FIG. 1 is a partially broken away perspective view of a cigarette having a ventilated filter tip in accordance with one embodiment of the present invention.

FIG. 1 illustrates a smoking product 10, such as a cigarette, which includes a tobacco end 11 and a filter rod 12. Filter rod 12 may be formed on any of the standard materials employed for filtration of smoke, such as, for example, paper or cellulose acetate.

Surrounding filter rod 12 is a plug wrap 13, which is inherently porous. Such wraps are commercially available from various manufacturers. Generally, porous plug wraps have an air flow rate under a head of 1 inch water gauge of about 3 to 18 cc/sec.

Plug wrap 13 is adhered to tipping paper 14, which also is inherently porous and commercially available. Porosities of such tipping paper are measured similarly as plug wraps and have a flow rate of about 3 to 7 cc/sec. Tipping paper 14 encloses both tobacco column 11 and rod 12 as covered by wrap 13. Junction 16 between column 11 and rod 12 is indicated by dashed lines.

It should be understood that the term "tipping paper" is used generically to simplify the subject matter of this disclosure. Other equivalent materials having desired porosities and characteristics suitable for use in smoking products may be employed in place of paper.

For ease of description, smoking product 10 illustrated in FIG. 1 is shown with both plug wrap 13 and tipping paper 14 broken away. The thickness of each has been exaggerated. A multiplicity of adhesive lakes 17, whose sizes are exaggerated, are positioned on wrap 13. As discussed elsewhere, lakes 17 are ordinarily formed while the adhesive is wet upon the tipping paper before it is adhered to the plug wrap. Lakes 17 are non-porous discrete areas of adhesive positioned between tipping paper 14 and wrap 13 and adhere them together.

The area between lakes 17 is indicated generally at 18. This area, which is between the discrete lakes of adhesive, permits passage of air through the inherently porous plug wrap 13 and tipping paper 14.

The adhesive lakes formed in accordance with the present invention can easily be identified by electron microphotography. It has been determined that the average diameter and thickness of the lakes formed in accordance with the teachings herein are, respectively, about 100 to 500 microns and about 5 to 19 microns. It has been noted that when the average diameter of the lakes is less than about 100 microns, bonding problems between the plug wrap and tipping paper occur, leading to loose filter tips. At over 500 microns in average diameter, the adhesive lakes are so large as to essentially approach a continuous layer characteristic, providing little ventilation into the filter. It is undesirable for similar reasons to have thicknesses less than about 5 microns or greater than about 19 microns.

Figure 2:
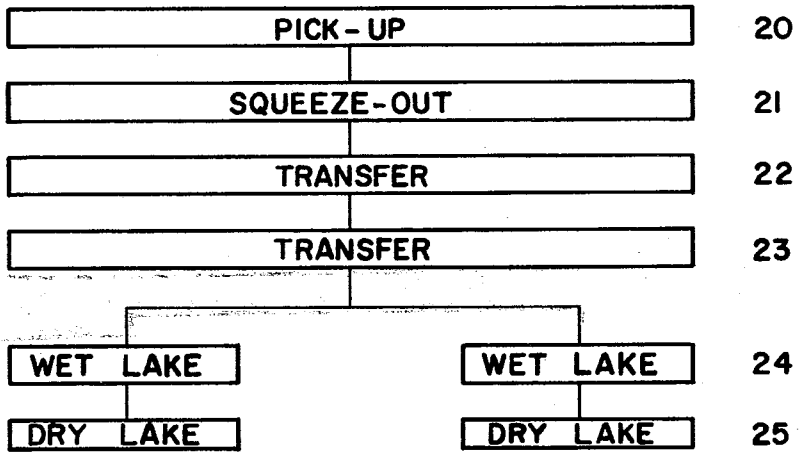
FIG. 2 is a flow chart illustrating a method of making a ventilated filter tip in accordance with the present invention.

To provide a clear description of a process of the present invention, it is considered appropriate to refer to the flow diagram of FIG. 2. As indicated generally at 20, the adhesive is first picked up by an applicator means, generally a roller having an appropriate relief pattern impressed thereupon, which is optionally squeezed of excess adhesive, as shown in block 21. A continuous film of adhesive is transferred at 22 to a transfer roller. Some laking of the adhesive generally occurs on the transfer roller prior to the second transfer indicated at 23 to the tipping paper. Laking continues on the tipping paper as shown at 24. When the adhesive is dry (illustrated at 25), the lakes have become thinner but retain the same average diameters. As stated before, it is necessary that the adhesive be applied to the transfer roller, transfer 22, just after the squeeze out at 21, as a substantially continuous film. The continuous nature of the film permits a concise, predictable number of adhesive lakes to be formed on the tipping paper. It has also been determined that the viscosity of the adhesive should be from about 5 to 14 $\times 10^3$ centipoise. Below about $5 \times 10^3$ centipoise, the adhesive does not adequately lake to provide open areas for proper ventilation. Above about $14 \times 10^3$ centipoise, handling the adhesive becomes a serious problem, since it becomes very difficult to transfer.

It is important to observe the solids content limits, since at less than 40% solids the adhesive has a long open or hardening time and in the dry state is too porous and tends to bleed through the tipping. Above 60% solid, the open time is too short to handle properly.

Adhesives which have been found to be satisfactory are latex adhesives, such as polyvinyl acetate and hydroxyethyl cellulose emulsions. Other adhesives, such as solvent-based adhesives and foamed adhesives, may also be employed.

Figure 3:
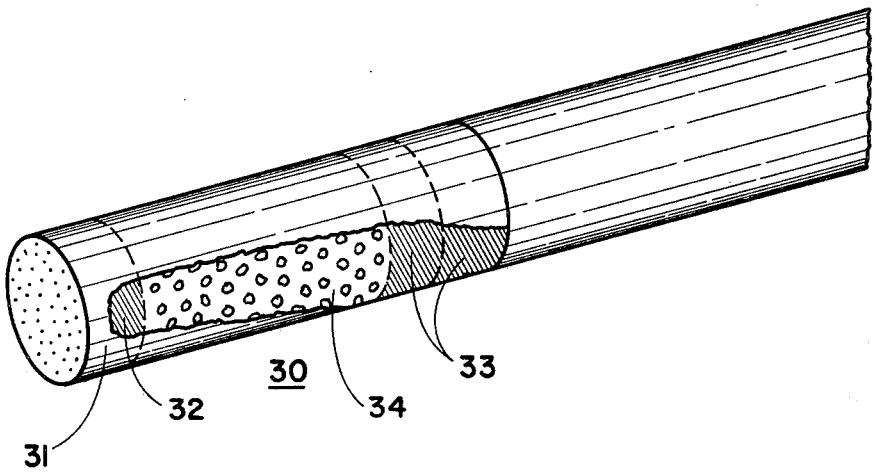
FIG. 3 is a partially broken away perspective view of a cigarette having a ventilated filter in accordance with another embodiment of the present invention.

It is important that the tipping paper be firmly adhered to the plug wrap at the tobacco column, filter rod junction and at the mouth end to avoid improper sealing, which leads to leakage. One means for accomplishing this is depicted in FIG. 3, which illustrates perspectively a cigarette having a filter tip 30 adjacent a rod of smoking material. Tipping paper 31 is broken away to show the continuous layers of glue applied to regions 32, 33. Region 32 is the portion of the tipping paper which will be inserted in the smoker's mouth while region 33 will be positioned above the junction between tobacco column and filter rod. Region 34 is the portion of the tipping having the discrete, nonporous areas of adhesive.

As discussed earlier, a smoker can, by varying the length of filter rod inserted into the mouth, also vary the ventilation rate of the filter assembly. By virtue of rendering that portion nonporous due to the substantially continuous layer of adhesive, the variance caused by the smoker is minimized or eliminated. Similarly, variances caused by mismatches between rod and tobacco column are eliminated by the adhesive seal above the junction. It has been found that it is necessary for the applicator roll to pick up wet adhesive in an amount above about 1.3 to 5.0 mg/cm$^2$, depending on the particular adhesive, to provide a continuous nonporous film on the tipping paper. This range of wet adhesive overlaps that described for forming the non-continuous layer because of the nature of various adhesives. It will now be evident that for a given tipping product employing the same adhesive throughout, the range employed for continuous layers will not overlap that employed for non-continuous layers.

FIG. 4 depicts an adhesive roller 40 which may be employed in a process for making a filter tip described in FIG. 3. In operation, roller 40 would move against a transfer roller which in turn would transfer the adhesive to tipping paper 41. For purposes of simplicity, the transfer roller has been omitted from FIG. 4. Similarly, the depth of the roller recesses and the width of various areas have been exaggerated to promote clarity.

In normal filter tip cigarette manufacture, two cigarettes are formed together, i.e., tobacco sections are joined to opposite ends of a double length of filter material. Subsequently, the double cigarette is cut through the center so as to form the individual cigarettes. The roller illustrated in FIG. 4 is made to form a double length of tipping paper for such cigarette formation. The roller is provided with a relief pattern having areas which retain very small amounts of adhesive, other areas which retain enough adhesive to provide a good seal to mouth and junction portions of tipping paper 41, and still other areas retaining sufficient adhesive to permit the appropriate laking to occur for formation of the discrete adhesive areas on the tipping paper.

Areas 44, 45 represent the regions of the tipping paper which are to be wrapped about the junction between the filter rod and tobacco column. Larger amounts of adhesive must be applied to provide for a substantially continuous layer of nonporous adhesive. Areas 46, 47 represent the regions of the tipping paper on which the adhesive lakes. Areas 48, 49 are the portions of the tipping paper to be inserted in the mouth. The small thin area 50 is a portion of the tipping paper which is made adhesive-free to prevent adhesive build-up on the knife edge used in subsequent cutting operations. Consequently, adhesive is applied in amounts similar to that applied in areas 44 and 45.

As shown, the diameter of roller 40 is not recessed at 42*a*, 43*a*, 50*a*. Only very small amounts of adhesive are transferred from these areas. Areas 42*a* and 43*a* provide for mechanical support of the transfer roller, not shown. Area 50*a*provides for the adhesive-free area 50 on the tipping. Roller 40 also has recesses 44*a* and 45*a*, separated by recess 46*a*, and recesses 48*a*and 49*a*, separated by recess 47*a*. The depth of recesses 44*a*, 45*a* and 48*a*, 49*a* should be about 40 to 80 microns relative to the radius of the roller at 42*a*, 43*a*. This depth is sufficient to pick up enough adhesive which will coat the tipping paper with a continuous layer of nonporous adhesive in areas 44, 45, 48, 49, thus providing a good seal.

The depth of recesses 46*a*, 47*a* relative to the roller radius at 42*a*, 43*a* is significantly less than the depth of recesses 44*a*, 45*a*, 48*a* and 49*a*, i.e., about 5 to 50 microns. In this manner, employing adhesives with viscosities as indicated, the adhesive picked up by roller 40 in recesses 46*a*, 47*a* lakes to provide the randomly positioned, discrete, nonporous areas of adhesive on tipping paper 41 for the purposes described.

In order that those skilled in the art may be better enabled to practice the present invention, the examples in the accompanying table are given. The examples, however, should be considered as illustrative only. In each example, a series of filter tips were formed having a 25 mm length of 3.9 × 40 cellulose acetate rods. These were employed in conjunction with standard blended sections. The plug wrap and tipping paper employed were commercially available. The adhesives utilized were polyvinyl acetate emulsion (PVA) and hydroxyethyl cellulose emulsion (HEC), both of which are also commercially available.

To facilitate brevity, the follwing abbreviations are used:

Adhesive — Ad.
Solids Content — S.C.
Applicator — Appl.
Density — Dens.
Predicted — Pr.
Observed — Obs.
Viscosity — Vis.

Unless otherwise specified, viscosity units are in centipoise × $10^3$, solids content is in percent by weight adhesive, and density is in gms/cm$^3$.

As is easily seen, various combinations of plug wrap and tipping papers were used with PVA and HEC emulsions of varying parameters, but within the limitations stated. In all products so fabricated, there was significantly tar reduction ranging from below 7 to above 30%.

| EXAMPLE | Plug Wrap (cc/sec) | Tipping (cc/sec) | Ad. | Ad. Vis. | Ad. S.C. | Ad. Dens. | Appl. Depth μm | $V_{ptg}$ (cc/sec) Pr. | $V_{ptg}$ (cc/sec) Obs. |
|---|---|---|---|---|---|---|---|---|---|
| 1 | 3.4 | 2.8 | PVA | 8.7 | 47.6 | 1.08 | 42 | 0.32 | 0.3 |
| 2 | " | 7.2 | " | " | " | " | " | — | — |
| 3 | " | 3.2 | HEC | 10.0 | 49.4 | 1.11 | 38 | 0.8 | 0.8 |
| 4 | " | " | " | " | " | " | 20 | — | — |
| 5 | " | " | PVA | 6.8 | 53.8 | 1.08 | " | 0.56 | 0.7 |
| 6 | " | 4.3 | " | " | " | " | 33 | 0.35 | 0.5 |
| 7 | 7.7 | 5.0 | " | 8.7 | 47.6 | 1.08 | 42 | 0.68 | 0.6 |
| 8 | " | 7.2 | " | " | " | " | " | 0.81 | 0.9 |
| 9 | " | " | " | 11.5 | 48.6 | 1.08 | 42 | — | — |
| 10 | 13.8 | 3.2 | HEC | 10.0 | 49.4 | 1.11 | 38 | — | — |
| 11 | " | " | " | " | " | " | 20 | — | — |
| 12 | " | 4.3 | " | " | " | " | " | 1.65 | 1.4 |
| 13 | " | " | " | " | " | " | 38 | 0.87 | 1.0 |
| 14 | " | " | PVA | 6.8 | 53.8 | 1.08 | " | 1.15 | 1.1 |
| 15 | 17.8 | 7.2 | HEC | 10.0 | 49.4 | 1.11 | 38 | — | — |
| 16 | 4.9 | 4.3 | " | " | 48.0 | " | " | 0.61 | 0.61 |
| 17 | 5.6 | " | " | " | 48.0 | " | " | 0.64 | 0.64 |
| 18 | 14.6 | " | " | " | 48.0 | " | " | 0.88 | 0.99 |

An empirical relationship was derived from the many values obtained which gave surprisingly accurate prediction of the assembled filter ventilation, $V_{ptg}$. The relationship is as follows $$A_g = 1 - \frac{\text{Ad. Vis. (centipoise)}}{10^3} \times \frac{1}{\text{Appl. Depth Microns}} \quad (3)$$

where $A_g$ is the fractional area within a given ventilation area actually blocked off by the dry adhesive lakes.

The assembled filter posority, $V_{ptg}$, which is directly proportional to the amount of open area as seen in expression (2) then can be predicted by using the empirically derived value for the blocked area. It should be noted, however, that solids content of the wet adhesive is not in the empirical relationship (3). For the relation to be accurate, it has been found to be necessary that the solids content be within the already discussed 40 to 60% range.

The last two columns of the table show that predicted values of $V_{ptg}$ closely match that of the observed values obtained from the example cigarettes.

I claim:

1. A process of making a porous filter tip having a multiplicity of randomly positioned, nonporous, discrete areas between an inherently porous plug wrap and an inherently porous tipping wrap comprising a. wrapping the inherently porous plug wrap about a rod of filter material;

b. placing on at least a first part of an applicator a first continuous film of adhesive capable of laking, said adhesive having a thickness of between about 5 to 50 microns, a viscosity of between about 5 to 14 × $10^3$ centipoise, and a solids content of between about 40 to 60% by weight;

c. transferring the adhesive to the inherently porous tipping wrap whereupon laking occurs to form a multiplicity of discrete adhesive areas on the tipping paper; and d. adhering the inherently porous tipping wrap to the inherently porous plug wrap, thereby forming a multiplicity of nonporous discrete areas between the plug wrap and tipping wrap.

2. The process of claim 1, including placing a second continuous film on a second part of an applicator adjacent the first part, which has a thickness sufficiently great to cause the adhesive to form a continuous and substantially nonporous adhesive layer between the plug wrap and tipping paper adjacent the multiplicity of nonporous discrete areas.

3. The process of claim 2 wherein the continuous and substantially nonporous adhesive layer is formed at the mouth end of the filter tip.

4. The process of claim 1, including placing adhesive on second and third parts of the applicator separated by the first part in amounts sufficient to form two continuous and substantially nonporous layers of adhesive on the tipping paper separated by the multiplicity of discrete adhesive areas.

5. The process of claim 4 wherein the amounts of adhesive placed on the first part of the applicator is 0.8 to 3.0 mg/cm$^2$ wet adhesive and the amount of adhesive placed on the second and third parts of the applicator is from about 1.3 to 5.0 mg/cm$^2$ wet adhesive.

6. A process of making a porous filter tip having a multiplicity of randomly positioned, nonporous, discrete areas between an inherently porous plug wrap and an inherently porous tipping wrap comprising a. wrapping the inherently porous plug wrap about a rod of filter material;

b. placing on at least a first part of an applicator a first continuous film of adhesive selected from the group consisting of polyvinyl acetate emulsion and hydroxyethyl cellulose emulsion, said adhesive having a thickness of between about 5 to 50 microns, a viscosity of between about $5 \times 14 \times 10^3$ centipoise, and a solids content of between about 40 to 60% by weight;

c. transferring the adhesive to the inherently porous tipping wrap whereupon laking occurs to form a multiplicity of discrete adhesive areas on the tipping paper; and d. adhereing the inherently porous tipping wrap to the inherently porous plug wrap, thereby forming a multiplicity of nonporous discrete areas between the plug wrap and tipping wrap.

* * * * *

UNITED STATES PATENT AND TRADEMARK OFFICE

CERTIFICATE OF CORRECTION

PATENT NO. : 4,035,220

DATED : July 12, 1977

INVENTOR(S) : James R. Hammersmith

It is certified that error appears in the above-identified patent and that said Letters Patent are hereby corrected as shown below:

Column 1, line 57, change "inherently porous wrap" to --"inherently porous" plug wrap--.

Column 2, line 7, change "perfortions" to --perforations--; line 49, change "($cm^3$sec)" to --($cm^3$/sec)--.

Column 3, line 10, change "relates" to --related--.

Column 7, line 2, change "3.9 x 40" to --3.9 x/40--; line 9, change "follwing" to --following--; line 24, change "significantly" to --significant--;

in the chart, Example 6 under "Appl. Depth μmm" change "33" to --38--.

Column 10, line 7, change "adhereing" to --adhering--.

Signed and Sealed this

Twenty-fifth Day of April 1978

[SEAL]

Attest:

RUTH C. MASON
Attesting Officer

LUTRELLE F. PARKER
Acting Commissioner of Patents and Trademarks

UNITED STATES PATENT OFFICE

CERTIFICATE OF CORRECTION

Patent No. 4,035,220 Dated July 12, 1977

Inventor(s) James R. Hammersmith

It is certified that error appears in the above-identified patent and that said Letters Patent are hereby corrected as shown below:

Column 7 in the chart Column headed "Appl. Depth μm" should be --Appl. Depth μ--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*